US010385427B2

(12) United States Patent
Manabe et al.

(10) Patent No.: US 10,385,427 B2
(45) Date of Patent: Aug. 20, 2019

(54) WIRE ROD

(71) Applicant: NIPPON STEEL & SUMITOMO METAL CORPORATION, Tokyo (JP)

(72) Inventors: Toshiyuki Manabe, Chiba (JP); Arata Iso, Chiba (JP); Naoki Matsui, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/533,227

(22) PCT Filed: Dec. 15, 2015

(86) PCT No.: PCT/JP2015/085057

§ 371 (c)(1),
(2) Date: Jun. 5, 2017

(87) PCT Pub. No.: WO2016/098765

PCT Pub. Date: Jun. 23, 2016

(65) Prior Publication Data

US 2017/0342530 A1 Nov. 30, 2017

(30) Foreign Application Priority Data

Dec. 15, 2014 (JP) ..... 2014-253267
Dec. 10, 2015 (JP) ..... 2015-241561

(51) Int. Cl.
*C22C 38/02* (2006.01)
*C22C 38/00* (2006.01)
(Continued)

(52) U.S. Cl.
CPC ..... *C22C 38/28* (2013.01); *C21D 9/525* (2013.01); *C22C 38/00* (2013.01); *C22C 38/001* (2013.01);
(Continued)

(58) Field of Classification Search
CPC ..... C22C 38/02; C22C 38/00; C22C 38/04; C22C 38/06; C22C 38/14; C22C 38/18; C22C 38/28; C22C 38/32
(Continued)

(56) References Cited

U.S. PATENT DOCUMENTS 6,322,641 B1 11/2001 Makii et al.
2005/0087270 A1* 4/2005 Nagao ..... B21C 1/04 148/595
(Continued)

FOREIGN PATENT DOCUMENTS

CN 101208445 A 6/2008
CN 101331244 A 12/2008
(Continued)

OTHER PUBLICATIONS

Extended European Search Report for Application No. 15869970.2, dated Mar. 26, 2018.
(Continued)

*Primary Examiner* — Brian D Walck
(74) *Attorney, Agent, or Firm* — Birch, Stewart, Kolasch & Birch, LLP

(57) ABSTRACT

A wire rod according to an aspect of the present invention has a predetermined chemical composition, a solute N is 0.0015% or less, a structure in an area from a surface of the wire rod to a depth of ¼ of a diameter of the wire rod in a cross section thereof includes 90.0 area % or more of pearlite, and 0 to 10.0 area % in total of bainite and ferrite, a total amount of martensite and cementite in the area from the surface of the wire rod to the depth of ¼ of the diameter of the wire rod is limited to 2.0 area % or less, and the calculated maximum size of TiN-type inclusions in a surface layer area of the wire rod is 50 μm or less.

2 Claims, 2 Drawing Sheets

(51) Int. Cl.

| | |
|---|---|
| ***C22C 38/04*** | (2006.01) |
| ***C22C 38/06*** | (2006.01) |
| ***C22C 38/14*** | (2006.01) |
| ***C22C 38/18*** | (2006.01) |
| ***C22C 38/28*** | (2006.01) |
| ***C22C 38/32*** | (2006.01) |
| ***C22C 38/22*** | (2006.01) |
| ***C22C 38/24*** | (2006.01) |
| ***C22C 38/26*** | (2006.01) |
| ***C21D 9/52*** | (2006.01) |
| *C21D 8/06* | (2006.01) |

(52) U.S. Cl.
CPC ..... *C22C 38/02* (2013.01); *C22C 38/04* (2013.01); *C22C 38/06* (2013.01); *C22C 38/14* (2013.01); *C22C 38/22* (2013.01); *C22C 38/24* (2013.01); *C22C 38/26* (2013.01); *C22C 38/32* (2013.01); *C21D 8/065* (2013.01); *C21D 2211/009* (2013.01)

(58) Field of Classification Search
USPC ..... 148/320
See application file for complete search history.

(56) References Cited

U.S. PATENT DOCUMENTS

| | | | |
|---|---|---|---|
| 2009/0151824 | A1 | 6/2009 | Yamasaki et al. |
| 2010/0212786 | A1 | 8/2010 | Yamasaki et al. |
| 2013/0216423 | A1 | 8/2013 | Oura et al. |

FOREIGN PATENT DOCUMENTS

| | | | |
|---|---|---|---|
| EP | 1 559 805 | A1 | 8/2005 |
| EP | 2 062 991 | A1 | 5/2009 |
| EP | 2 083 094 | A1 | 7/2009 |
| EP | 2 634 280 | A1 | 9/2013 |
| GB | 1 428 889 | A | 3/1976 |
| JP | 52-40627 | B2 | 10/1977 |
| JP | 2000-355736 | A | 12/2000 |
| JP | 2005-163082 | A | 6/2005 |
| JP | 2009-24245 | A | 2/2009 |
| JP | 2009-280836 | A | 12/2009 |
| JP | 2010-229469 | A | 10/2010 |
| JP | 2012-97300 | A | 5/2012 |
| JP | 2013-204069 | A | 10/2013 |
| JP | 3599551 | B2 | 10/2013 |
| JP | 5425744 | B2 | 2/2014 |
| JP | 2014-189855 | A | 10/2014 |
| WO | WO 2014/175345 | A1 | 10/2014 |

OTHER PUBLICATIONS

International Search Report for PCT/JP2015/085057 dated Mar. 22, 2016.

Ohba et al., "High performance wire rods product which utilized DLP", Nippon Steel Corporation Technical Report, 2007, No. 386, pp. 47-53, total 8 pages.

Written Opinion of the International Searching Authority for PCT/JP2015/085057 (PCT/ISA/237) dated Mar. 22, 2016.

Chinese Office Action and Search Report dated Feb. 12, 2018 for corresponding Chinese Application No. 201580067879.4, with English translation of the Search Report.

Author unknown, "Welding Handbook-Material Welding 3rd Edition," Welding Society of the Chinese Mechanical Engineering Society China Machine Press, Jan. 31, 2008, pp. 297-298 (4 total pages).

Chinese Office Action and Search Report, dated Oct. 8, 2018, for corresponding Chinese Application No. 201580067879.4, with an English translation.

* cited by examiner

WIRE ROD

TECHNICAL FIELD OF THE INVENTION

The present invention relates to a wire rod.

Priority is claimed on Japanese Patent Application No. 2014-253267, filed on Dec. 15, 2014, and Japanese Patent Application No. 2015-241561, filed on Dec. 10, 2015, the contents of which are incorporated herein by reference.

RELATED ART

There is concern that high carbon steel wires which are subjected to drawing and are used for various applications such as steel wires for bridge cables, PC steel wire, ACSR, and various ropes undergo strain ageing due to deformation heating that occurs during drawing and strain ageing at room temperature after the drawing and thus become embrittled. Due to the embrittlement, longitudinal cracking (delamination) is likely to occur during drawing and twisting of the steel wires, and deteriorating of ropes due to stranding is likely to occur. Therefore, such a wire rod requires suppression of strain ageing. Furthermore, high carbon steel wire rods used for steel wires for bridge cables, PC steel wire, and various wire ropes require good drawability in order to obtain high strength and high ductility steel wires, and reduce troubles which cause a reduction in productivity such as breaking of wires during the manufacturing of steel wires.

In order to suppress strain ageing, methods of reducing the reduction per pass and strengthening cooling during drawing in order to suppress deformation heating during drawing when a wire rod is subjected to secondary processing have been employed. For example, Patent Document 1 proposes a method of strengthening cooling during drawing of a wire rod by directly performing water cooling on the wire rod immediately after the drawing at the outlet of a die for the drawing of the wire rod. However, this method relates to a method of processing a wire rod and is not related to the configuration of a wire rod. It is important to improve the ductility of a wire rod in order to reduce troubles without using these methods or to further reduce troubles in combination with these methods. However, means for improving the ductility of a wire rod are not examined in Patent Document 1.

It is known that reducing the amount of interstitial atoms (particularly N) in steel, which is a cause of strain ageing, is effective in suppressing strain ageing. On the basis of this knowledge, a method of causing alloying elements that form a compound with nitrogen, such as boron, niobium, and aluminum, to be included in a wire rod has been used for suppressing strain ageing. In Patent Document 2, a high carbon steel wire rod, in which the amounts of boron and niobium are controlled and excellent longitudinal cracking resistance is provided, is proposed. However, in Patent Document 2, only the longitudinal cracking resistance of a patenting material after dry drawing is examined, and the amount of free N, which is an element that affects the longitudinal cracking resistance, is adjusted by a patenting treatment after the drawing. Therefore, even in Patent Document 2, a technique for improving the ductility and the like of a wire rod before drawing is not disclosed.

In order to suppress strain ageing due to deformation heating during drawing, a high carbon steel wire rod in which the amount of solute nitrogen is reduced by controlling the amount of Ti to an appropriate amount, the diffusion of solute carbon in ferrite is suppressed, and excellent drawability is provided, is proposed (Patent Document 3).

However, in order to guarantee good drawability, first, adjustment of the lamellar spacing, block size, and the like of pearlite is necessary. In the technique of Patent Document 3, an extremely complex heat treatment is required for adjusting the structure of pearlite of the wire rod. However, there may be cases where the effect of Ti varies in the process of the heat treatment. Furthermore, in a manufacturing method of Patent Document 3, since a rough rolling temperature is 950° C. or lower, which is lower than a general rolling temperature, high rigidity is required for a rolling mill, there is a higher possibility of occurrence of defects, and there are problems in facilities and production.

Similarly, a wire rod for a high strength steel wire in which precipitation of pro-eutectoid cementite at a center segregation portion is suppressed due to TiC precipitates by controlling the amount of Ti to an appropriate amount, the amount of solute nitrogen is reduced, and excellent drawability of as rolled wire rod is achieved is proposed (Patent Document 4). According to Non-Patent Document 1, the presence or absence of precipitation of pro-eutectoid cementite is determined by the amount of carbon and a cooling rate. According to the method of Patent Document 4, regarding the precipitation limit of pro-eutectoid cementite, it is thought that pro-eutectoid cementite at the center segregation portion is suppressed by the effect of improving the balance between the amount of carbon and the cooling rate and thus breaking at the time of drawing is suppressed. However, for a steel wire which requires a patenting treatment with molten salt or molten lead which is less likely to cause precipitation of pro-eutectoid cementite, it is difficult to obtain the effect.

Furthermore, focusing on the structure of pearlite, a wire rod in which a drawing limit reduction is improved by refining block (nodule) sizes and thus excellent drawability is achieved is proposed (Patent Document 5). However, in Patent Document 5, by controlling the cooling rate during a heat treatment, the structure of the wire rod is transformed at a low temperature to refine the block sizes. In this case, the strength of the wire rod cannot be controlled during the heat treatment. Therefore, according to the technique described in Patent Document 5, as means for controlling the strength of the wire rod, there is only adjustment of the composition of steel. Therefore, ductility cannot be improved while maintaining a target strength.

Regarding IF steels (steels manufactured by a method in which the amount of C and the amount of N are excessively low), it has been widely known that nitrogen and carbon are fixed as TiN, TiC, and the like by adding titanium and niobium, which are likely to form nitrides. However, in a high carbon steel having a high strength of higher than 1,000 MPa, coarse TiN formed by the addition of Ti may become the origin of fatigue fracture and the origin of hydrogen embrittlement.

In Patent Document 6, a wire rod in which the ferrite content at the surface of the wire rod is limited by using free B and accordingly mechanical properties can be improved is proposed. However, in Patent Document 6, strain ageing of a wire rod has not been examined. In addition, it is necessary to reduce the amount of solute N in order to sufficiently suppress the strain ageing. However, in a manufacturing method described in Patent Document 6, the amount of solute N cannot be sufficiently reduced by fixing N.

In Patent Document 7, a wire rod for a spring in which fatigue properties are improved by controlling the thickness of TiN-type inclusions to be in an appropriate range is proposed. However, in Patent Document 6, only a method of improving the fatigue properties of the wire rod having a chemical composition with a relatively low C content is proposed. The deterioration of the fatigue properties due to an increase in the C content is not examined in Patent Document 6. Therefore, the technique of Patent Document 6 cannot be applied to a high strength wire rod that needs to have a C content of 0.75% or more.

As described above, it is difficult to obtain a wire rod that is excellent in drawability and fatigue resistance and furthermore, is excellent in ductility according to a well-known technique.

PRIOR ART LITERATURE

Patent Literature

[Patent Document 1] Japanese Patent No. 911100
[Patent Document 2] Japanese Unexamined Patent Application, First Publication No. 2005-163082
[Patent Document 3] Japanese Patent No. 5425744
[Patent Document 4] Japanese Unexamined Patent Application, First Publication No. 2014-189855
[Patent Document 5] Japanese Patent No. 3599551
[Patent Document 6] Japanese Unexamined Patent Application, First Publication No. 2000-355736
[Patent Document 7] Japanese Unexamined Patent Application, First Publication No. 2009-24245

Non-Patent Literature

[Non-Patent Document 1] "High performance wire rods product which utilized DLP" by Hiroshi OHBA, et al., Nippon Steel Corporation, Nippon Steel Technical Report No. 386, p. 49, March 2007

DISCLOSURE OF THE INVENTION

Problems to be Solved by the Invention

The present invention has been made taking the foregoing circumstances into consideration, and an object thereof is to provide a wire rod excellent in drawability, fatigue resistance, and hydrogen embrittlement resistance.

Means for Solving the Problem

The gist of the present invention is as follows.

(1) According to an aspect of the present invention, a wire rod includes: in terms of mass %, C: 0.75% to 1.2%; Si: 0.10% to 1.4%; Mn: 0.1% to 1.1%; Ti: 0.008% to 0.03%; S: 0.030% or less; P: 0.03% or less; N: 0.001% to 0.005%; Al: 0% to 0.1%; Cr: 0% to 0.6%; V: 0% to 0.1%; Nb: 0% to 0.1%; Mo: 0% to 0.2%; W: 0% to 0.5%; B: 0% to 0.003%; and a remainder consisting of Fe and impurities, in which a solute N is 0.0015% or less, a structure in an area from a surface of the wire rod to a depth of ¼ of a diameter of the wire rod in a cross section thereof includes 90.0 area % or more of pearlite, and 0 to 10.0 area % in total of bainite and ferrite, a total amount of martensite and cementite in the area from the surface of the wire rod to the depth of ¼ of the diameter of the wire rod is limited to 2.0 area % or less, a part from the surface of the wire rod to a depth of 10% of the diameter of the wire rod is defined as a surface layer area of the wire rod, a maximum circle equivalent diameter of TiN-type inclusions included in visual field of 12 $mm^2$ in a cross section, which is parallel to a rolling direction and which includes a center of the wire rod, of the surface layer area is defined as an actual maximum size of TiN-type inclusions in the surface layer area of the wire rod, an estimate value of a maximum circle equivalent diameter of the TiN-type inclusions included in the surface layer area of the wire rod having a length corresponding to a coil of 2 tons, which is obtained by extreme value statistical processing a Weibull plot created by the actual maximum size of the TiN-type inclusions in 12 or more of the visual fields of the surface layer area of the wire rod, is defined as a calculated maximum size of TiN-type inclusions in the surface layer area of the wire rod, and the calculated maximum size of the TiN-type inclusions in the surface layer area of the wire rod is 50 μm or less.

(2) The wire rod described in (1) may further include: in terms of mass %, S: 0.003% to 0.030%, in which a sulfide which is distributed along a prior austenite grain boundary and has an average number density of 0.025/$\mu m^3$ or more and a grain size of 10 to 100 nm may be included in the area from the surface of the wire rod to the depth of ¼ of the diameter of the wire rod.

(3) The wire rod described in (1) or (2) may further include: in terms of mass %, one or more selected from the group consisting of Al: 0.001% to 0.1%; Cr: 0.03% to 0.6%; V: 0.005% to 0.1%; Nb: 0.005% to 0.1%; Mo: 0.005% to 0.2%; W: 0.010% to 0.5%; and B: 0.0004% to 0.003%.

Effects of the Invention

According to the aspect of the present invention, a wire rod which is excellent in drawability, fatigue resistance, and hydrogen embrittlement resistance can be provided.

EMBODIMENTS OF THE INVENTION

Figure 1:
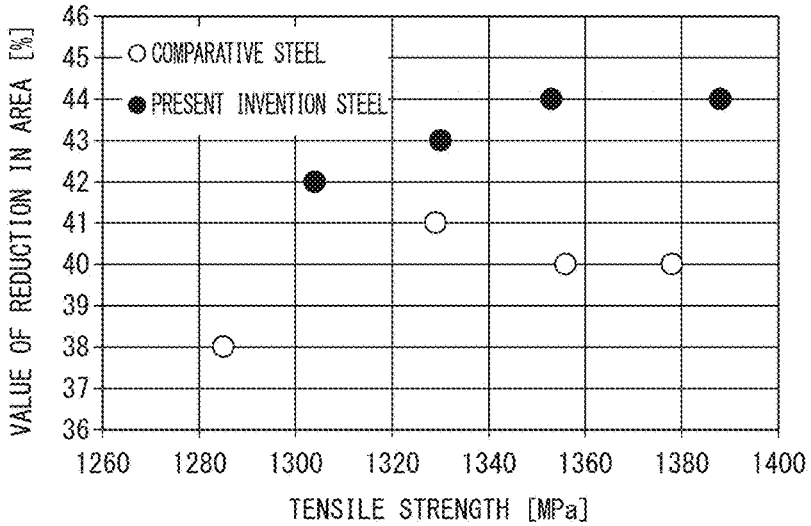
FIG. 1 is a graph showing the relationship between the tensile strength and the value of a reduction in the area of wire rods according to an embodiment in which the state of sulfides is preferably controlled, and wire rods according to the related art.

In order to reduce the amount of solute N, which is a cause of strain ageing, it is effective to fix N by forming TiN-type inclusions such as Ti nitrides and Ti carbonitrides. However, coarse TiN-type inclusions cause deterioration of drawability and the like. In order to solve this problem, the inventors attempted to optimize the chemical composition and the thermal history of steel in a steelmaking stage. As a result, it was found that by setting the amount of Ti and the amount of N to be in appropriate ranges and furthermore, suitably controlling the cooling conditions during casting and the heating temperature of a billet during rolling, the amount of solute N is reduced, and the size of TiN-type inclusions are refined. In this embodiment, the "TiN-type inclusions" include Ti nitrides such as TiN and Ti carbonitrides such as Ti(C,N).

Furthermore, the inventors thought that it is good to refine austenite grain sizes during wire-rod-rolling in order to improve the ductility of the wire rod. This is because in a case where the austenite grain sizes are refined during the wire-rod-rolling, the sizes of pearlite blocks formed in the subsequent process can be refined and the ductility of the wire rod can be improved. On the other hand, the inventors found that it is difficult to sufficiently refine the austenite grain sizes by controlling the heating temperature, rolling reduction, and the like during the wire-rod-rolling. Therefore, the inventors conducted further investigation, and as a result, found that by controlling the amounts of Ti and Mn (particularly Ti) and S and the bloom cooling conditions and bloom heating conditions during casting before the wire-rod-rolling, sulfides can be finely dispersed in a billet before the wire-rod-rolling and the fine sulfides refine the austenite grain sizes of the wire rod during the wire-rod-rolling.

Hereinafter, an embodiment of the present invention obtained from the above-described findings will be described.

First, the chemical composition of a wire rod according to the embodiment of the present invention (hereinafter, referred to as a wire rod according this embodiment) will be described. In the following description of the chemical composition, the unit "%" of the amount of each alloying element means "mass %".

C: 0.75% to 1.2%

C has an effect of increasing the strength of the wire rod by increasing a cementite fraction and refining the lamellar spacing of a pearlite. In a case where the C content is less than 0.75%, it is difficult to form 90 area % or more of the pearlite in an area from the surface of the wire rod to a depth of ¼ of the diameter of the wire rod. In a case where the C content exceeds 1.2%, pro-eutectoid cementite precipitates and deteriorates the drawability of the wire rod. Furthermore, in a case where the C content exceeds 1.2%, the liquidus temperature of the wire rod decreases, so that a segregation portion of the wire rod melts at a manufacturing stage and the possibility of breaking of the wire rod increases. The preferable lower limit of the C content is 0.77%, 0.80%, or 0.82%. The preferable upper limit of the C content is 1.1%, 1.05%, or 1.02%.

Si: 0.10% to 1.4%

Si is a deoxidizing element and is an element for solid solution strengthening of ferrite. In a case where the Si content is less than 0.10%, sufficient hardenability cannot be secured during a heat treatment and it becomes difficult to control an alloy layer during galvanization. In addition, in a case where the Si content exceeds 1.4%, decarburization is promoted during heating of the wire rod and a mechanical descaling property is deteriorated. Therefore, the upper limit of the Si content is 1.4%. The preferable lower limit of the Si content is 0.12%, 0.15%, or 0.18%. The preferable upper limit of the Si content is 1.35%, 1.28%, or 1.25%.

Mn: 0.1% to 1.1%

Mn is a deoxidizing element and is a hardenability improving element. In a case where the Mn content is less than 0.1%, sufficient hardenability cannot be secured during the heat treatment. In addition, in a case where the Mn content exceeds 1.1%, the initiation of pearlitic transformation is delayed, and it becomes difficult to form 90 area % or more of the pearlite in the area from the surface of the wire rod to the depth of ¼ of the diameter of the wire rod. A preferable lower limit of the Mn content is 0.15%, 0.18%, or 0.2%. A preferable upper limit of the Mn content is 1.00%, 0.95%, or 0.90%.

Ti: 0.008% to 0.03%

Ti is a deoxidizing element and is an element which has an action of fixing N in the wire rod and thus improving the drawability of the wire rod. Furthermore, Ti more stably forms sulfides at higher temperatures than MnS, which precipitates on the austenite grain boundaries and functions as pinning particles, thereby contributing to refinement of austenite grains. In order to obtain this action, 0.008% or more of Ti is included. On the other hand, in a case where the Ti content is excessive, coarse hard inclusions are formed, which impedes the drawability of the wire rod. Therefore, the upper limit of the Ti content is set to 0.03%. The preferable lower limit of the Ti content is 0.010%, 0.012%, or 0.014%. The preferable upper limit of the Ti content is 0.028%, 0.026%, or 0.024%.

S: 0.030% or Less

An excessive amount of S impairs the ductility of the wire rod. In particular, in a case where the S content exceeds 0.0030%, it is impossible to sufficiently improve the ductility of the wire rod. Therefore, the upper limit of S is set to 0.030%. The preferable upper limit of the S content is 0.020%, 0.018%, or 0.015%. In addition, in the wire rod according to this embodiment, the inclusion of S is not essential, and thus the lower limit of the S content is 0%.

However, it is preferable that a steel wire according to this embodiment contains 0.003% or more of S. According to a well-known technique, it is said that the amount of S in steel having high ductility should be as low as possible. However, the inventors found that in a case where the amount of Ti and the heat treatment conditions during manufacturing are appropriately controlled, S precipitates as fine sulfides on the austenite grain boundaries of the wire rod during the manufacturing. The fine sulfides function as pinning particles to refine the austenite grains and refine the structure of the wire rod that can be finally obtained, thereby further improving the ductility of the wire rod according to this embodiment. In a case where 0.003% or more of S is contained in the wire rod, the above-described effect can be obtained. An even more preferable lower limit of the S content is 0.004%, 0.005%, or 0.006%.

P: 0.03% or Less

P impairs the ductility of the wire rod according to this embodiment. In particular, in a case where the P content exceeds 0.03%, it is impossible to sufficiently improve the ductility of the wire rod. Therefore, the upper limit of the P content is set to 0.03%. The preferable upper limit of the P content is 0.025%, 0.020%, or 0.015%. Since the P content is preferably reduced as much as possible, the lower limit of the P content is 0%.

N: 0.001% to 0.005%

Solute N: 0.0015% or Less

N is an impurity. N that is present in the wire rod in a solute state deteriorates the ductility of the wire rod and further reduces the drawability of the wire rod and the ductility of the wire after the drawing due to strain ageing during drawing. Therefore, the amount of solute N needs to be reduced as much as possible. In order to prevent deterioration of the drawability of the wire rod and the ductility of the wire, it is necessary to set the amount of solute N to 0.0015% or less. The preferable upper limit of the solute N amount is 0.0012%, 0.0010%, or 0.0008%. The amount of solute N (sol. N) is calculated based on the ammonia distillation separation amidosulfuric acid titrimetric method defined in JIS G 1228 "Iron and steel—Methods for determination of nitrogen content".

In a case where the total amount of N (the amount of all N including N in a solute state, N forming inclusions, and the like) exceeds 0.005%, it becomes difficult to cause the amount of solute N to be 0.0015% or less. On the other hand, controlling the total amount of N to less than 0.001% unnecessarily increases the production costs and affects the control of other impurities. Therefore, the lower limit of the total amount of N was set to 0.001%. The preferable upper limit of the total amount of N is 0.0042%, 0.0040%, or 0.0036%.

In addition to the elements described above, the wire rod according to this embodiment may contain one or more arbitrary element selected from the group consisting of Al, Cr, V, Nb, Mo, W, and B in a range that does not impair the properties of the wire rod according to this embodiment. However, even though no arbitrary element is contained, the wire rod according to this embodiment can exhibit excellent properties, and thus the lower limit of each arbitrary element is 0%.

Al: Preferably 0.001% to 0.1%

Al is a deoxidizing element. In order to deoxidize the wire rod and improve the toughness of the wire rod, 0.001% or more of Al may be contained in the wire rod. On the other hand, in a case where the amount of Al exceeds 0.1%, hard inclusions are formed, the drawability is impaired, and furthermore, the stability of continuous casting is impaired. Therefore, the upper limit of the Al content is set to 0.1%. The preferable lower limit of the Al content is 0.002%, 0.004%, or 0.008%. The preferable upper limit of the Al content is 0.08%, 0.06%, or 0.05%.

Cr: Preferably More than 0% and 0.6% or Less

Cr is a hardenability improving element, and furthermore, is an element which improves the tensile strength of the wire rod by refining the lamellar spacing of pearlite. However, in a case where more than 0.6% of Cr is contained in the steel wire, a pearlitic transformation completion time is lengthened, and thus a long-term heat treatment is necessary. Therefore, productivity is reduced, and martensite which reduces the ductility and the like of the wire rod is likely to be formed. Furthermore, in a case where more than 0.6% of Cr is contained in the steel wire, pro-eutectoid cementite is likely to be formed and the mechanical descaling property deteriorates. Therefore, the upper limit of the Cr content is 0.6%. The preferable lower limit of the Cr content is 0.03%, 0.04%, or 0.05%. The preferable upper limit of the Cr content is 0.5%, 0.4%, or 0.35%.

V: Preferably More than 0% and 0.1% or Less

V is a hardenability improving element. Furthermore, in a case in which V precipitates as a carbonitride in an austenite region, V contributes to refinement of austenite grains, and in a case in which V precipitates as a carbonitride in a ferrite region, V contributes to an improvement of the strength of steel. On the other hand, in a case where more than 0.1% of V is contained in the steel wire, the pearlitic transformation completion time is lengthened, and thus a long-term heat treatment is necessary. Therefore, productivity is reduced, and martensite which reduces the ductility and the like of the wire rod is likely to be formed. Furthermore, in a case where more than 0.1% of V is contained in the steel wire, the ductility and toughness of the wire rod deteriorate due to the precipitation of coarse carbonitrides. Therefore, the upper limit of the V content was set to 0.1%. The preferable lower limit of the V content is 0.005%, 0.010%, or 0.015%. The preferable upper limit of the V content is 0.50%, 0.35%, or 0.20%.

Nb: Preferably More than 0% and 0.1% or Less

Nb is a hardenability improving element and is an element which acts as pinning particles in a case of precipitating as a carbonitride and thus contributes to a reduction in the pearlitic transformation completion time during the heat treatment and refinement of crystal grain sizes. On the other hand, in a case where more than 0.1% of Nb is contained in the wire rod, Nb acts in a solute state and the pearlitic transformation completion time is lengthened, and thus a long-term heat treatment is necessary. Therefore, productivity is reduced, and martensite which reduces the ductility and the like of the wire rod is likely to be formed. Furthermore, in a case where more than 0.1% of Nb is contained in the wire rod, coarse Nb (CN) precipitates and inhibits ductility. Therefore, the upper limit of the Nb content is set to 0.1%. The preferable lower limit of the Nb content is 0.005%, 0.008%, or 0.010%. The preferable upper limit of the Nb content is 0.050%, 0.035%, or 0.025%.

Mo: Preferably More than 0% and 0.2% or Less

Mo is an element for improving hardenability. Moreover, Mo is an element which refines the austenite grain sizes by the solute drug effect. On the other hand, in a case where more than 0.2% of Mo is contained in the wire rod, the pearlitic transformation completion time is lengthened, and thus a long-term heat treatment is necessary. Therefore, productivity is reduced, and martensite which reduces the ductility and the like of the wire rod is likely to be formed. Therefore, the upper limit of the Mo content is set to 0.2%. The preferable lower limit of the Mo content is 0.005%, 0.008%, or 0.010%. The preferable upper limit of the Mo content is 0.1%, 0.08%, or 0.06%.

W: Preferably More than 0% and 0.5% or Less

W is an element for improving hardenability. On the other hand, in a case where more than 0.5% of W is contained in the wire rod, the pearlitic transformation completion time is lengthened, and thus a long-term heat treatment is necessary. Therefore, productivity is reduced, and martensite which reduces the ductility and the like of the wire rod is likely to be formed. Therefore, the upper limit of the W content is set to 0.5%. The preferable lower limit of the W content is 0.010%, 0.016%, or 0.020%. The preferable upper limit of the W content is 0.20%, 0.16%, or 0.12%.

B: Preferably More than 0% and 0.003% or Less

In a state of solute B, B segregates at grain boundaries and suppresses the formation of ferrite, thereby improving drawability. Moreover, B decreases the amount of solute N in a case of precipitating as BN. On the other hand, in a case where the B content exceeds 0.003%, carbides of $M_{23}(C,B)_6$ precipitate at grain boundaries, resulting in a reduction in the drawability of the wire rod. Therefore, the upper limit of the B content is set to 0.003%. The preferable lower limit of the B content is 0.0004%, 0.0005%, or 0.0006%. The preferable upper limit of the B content is 0.0025%, 0.0020%, or 0.0018%.

In the chemical composition of the wire rod according to this embodiment, the remainder includes iron and impurities. The impurities are ingredients which are incorporated due to raw materials such as ore and scrap or various factors in a manufacturing process when steel is industrially manufactured and are allowed in a range in which the steel wire according to this embodiment is not adversely affected.

Next, the structure and inclusions of the wire rod according to this embodiment will be described.

Metallographic Structure in Area (¼D Portion) from Surface of Wire Rod to Depth of ¼ of Diameter of Wire Rod: Includes 90.0 Area % or More of Pearlite, and 0 to 10.0 Area % in Total of Bainite and Ferrite, in which Total Amount of Martensite and Pro-Eutectoid Cementite is Limited to 2.0 Area % or Less In order to preferably control mechanical properties, the wire rod according to this embodiment includes 90.0 area % or more of pearlite in an area (¼D portion) to a depth of ¼ of the diameter of the wire rod. The amount of pearlite in the ¼D portion may also be 100%. In addition, when the amount of ferrite and the amount of bainite increase, ductility decreases. Therefore, the sum of the amount of ferrite and the amount of bainite in the ¼D portion is set to 10 area % or less. Since ferrite and bainite need not be contained in the wire rod according to this embodiment, the lower limit of the sum of the amount of ferrite and the amount of bainite in the ¼D portion is 0%. Furthermore, since martensite and pro-eutectoid cementite degrade the mechanical properties of the wire rod, the sum of the amount of martensite and the amount of pro-eutectoid cementite in the ¼D portion needs to be limited to 2.0 area % or less. Since martensite and pro-eutectoid cementite need not be contained in the wire rod according to this embodiment, the lower limit of the sum of the amount of martensite and the amount of pro-eutectoid cementite in the ¼D portion is 0%. The preferable lower limit of the amount of pearlite in the ¼D portion is 95 area %, 97 area %, or 98 area %. The preferable upper limit of the sum of the amount of ferrite and the amount of bainite in the ¼D portion is 8 area %, 5 area %, or 2 area %. The preferable upper limit of the sum of the amount of martensite and the amount of pro-eutectoid cementite in the ¼D portion is 3 area %, 2 area %, or 1 area %. It is preferable that structures other than the above-described structure are not included in the ¼D portion of the wire rod according to this embodiment. However, there may be cases where the structures may be included in a range in which the properties of the wire rod are not affected.

Figure 3:
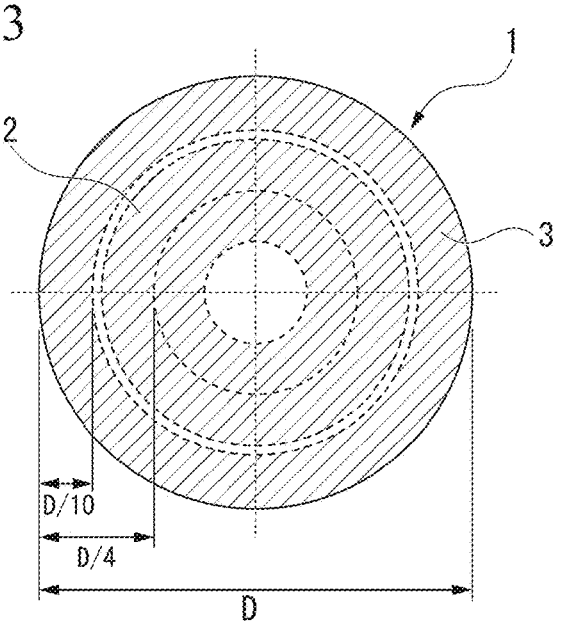
FIG. 3 is a cross-sectional view of the wire rod according to the embodiment.

Control of the amounts of pearlite, ferrite, bainite, martensite, pro-eutectoid ferrite, and the like is performed in the area (¼D portion) around the depth of ¼ of a diameter D of the wire rod from the surface of the wire rod. A ¼D portion 2 of the wire rod illustrated in FIG. 3 is an area around the surface having a depth of ¼ of the diameter D of a wire rod 1 from the surface of the wire rod 1. The ¼D portion of the wire rod may also be defined as an area between the surface having a depth of ⅛ of the diameter D of the wire rod from the surface of the wire rod and the surface having a depth of ⅜ of the diameter D of the wire rod from the surface of the wire rod. Since the ¼D portion of the wire rod is an area positioned between the surface of the wire rod which is most affected by a heat treatment and the center of the wire rod which is least affected by the heat treatment, the ¼D portion is an area having the most average properties in the wire rod. Therefore, this area was determined as a point where the amounts of pearlite, ferrite, bainite, martensite, pro-eutectoid ferrite, and the like are defined.

A method of measuring the amounts of pearlite, ferrite, bainite, martensite, and pro-eutectoid ferrite in the ¼D portion of the wire rod is, for example, as follows. First, the wire rod is embedded in a resin, and a C cross section of the wire rod is mirror-polished. Next, etching is performed on the cross section using picral, and 10 photographs of the area corresponding to the ¼D portion of the wire rod are randomly taken at a magnification of 2,000-fold by a scanning electron microscope (SEM). The area ratios of ferrite, bainite, martensite, and pro-eutectoid cementite contained in the obtained photographs are calculated by an image analyzer. The average value of the area ratios of each structure in the 10 photographs was used as the area ratio of each structure in the ¼D portion of the wire rod. Furthermore, a value obtained by subtracting the sum of the area ratios (non-pearlite area ratio) from 100% was used as the area ratio of pearlite in the ¼D portion of the wire rod.

Calculated Maximum Size of TiN-Type Inclusions in Surface Layer Area of Wire Rod: 50 μm or Less Since TiN-type inclusions become the origin of fatigue fracture or delayed fracture due to hydrogen embrittlement, the size of TiN-based inclusions affects the fatigue limit and fracture strength of the wire rod. According to the investigation by the inventors, it was determined that TiN-type inclusions do not adversely affect the fatigue limit of a wire when the size of the TiN-type inclusions is 50 μm or less. That is, the number density of the TiN-type inclusions having a diameter of more than 50 μm in the surface layer area of the wire rod needs to be substantially 0 grains/mm$^2$.

In order to define the state of the TiN-type inclusions in the surface layer area of the wire rod, the inventors defined a part from the surface of the wire rod to a depth of 10% of the diameter of the wire rod as the surface layer area of the wire rod, defined the maximum circle equivalent diameter of the TiN-type inclusions included in visual field of 12 mm$^2$ in a cross section, which is parallel to a rolling direction and which includes the center of the wire rod, of the surface layer area, as an actual maximum size of TiN-type inclusions in the surface layer area of the wire rod, and defined an estimate value of the maximum circle equivalent diameter of the TiN-type inclusions included in the surface layer area of the wire rod having a length corresponding to a coil of 2 tons, which is obtained by extreme value statistical processing a Weibull plot created by the actual maximum size of the TiN-type inclusions in 12 or more of the visual fields of the surface layer area of the wire rod, as a calculated maximum size of the TiN-type inclusions in the surface layer area of the wire rod. In a case where the calculated maximum size of the TiN-type inclusions is 50 μm or less, the number density of the TiN-type inclusions having a diameter of more than 50 μm in the surface layer area of the wire rod is regarded as substantially 0 grains/mm$^2$. In addition, in order to increase the fatigue limit and fracture strength of the wire rod, the calculated maximum size of the TiN-type inclusions is may be small. As is apparent from the above definition, the calculated maximum size of the TiN-type inclusions is a value calculated to estimate the maximum circle equivalent diameter of the TiN-type inclusions contained in the surface layer area of the wire rod having a length corresponding to the coil of 2 tons. In order to improve the estimation accuracy, it is necessary to increase the number of measurement visual fields used to calculate the calculated maximum size of the TiN-type inclusions, and in order to obtain sufficient estimation accuracy, it is necessary to increase the number of measurement visual fields to 12 or more. In addition, the measurement visual fields need to be randomly selected.

As described above, control of the state of the TiN-type inclusions is performed on a surface layer area 3 of the wire rod illustrated in FIG. 3 (the part from the surface of the wire rod to the depth of 10% of the diameter of the wire rod). Since fatigue fracture and delayed fracture easily occur from the surface layer area 3 of the wire rod, the surface layer area 3 of the wire rod is determined as a point where the state of the TiN-type inclusions is controlled in order to suppress fatigue fracture and delayed fracture.

Furthermore, the wire rod according to this embodiment may have sulfides which are distributed along prior austenite grain boundaries and have a diameter of 10 to 100 nm in the area around the ¼ depth of the wire rod. Types of the sulfides include TiS, MnS, and $Ti_4C_2S_2$, and the like. Any of TiS, MnS, and $Ti_4C_2S_2$ is a sulfide present in the vicinity of the prior austenite grain boundaries, and is a sulfide that have been known to have the pinning effect of austenite grain boundaries found by the inventors. Among these sulfides, particularly TiS and $Ti_4C_2S_2$, which are sulfides containing Ti, are preferable because they can be used for refining the austenite grain sizes. In addition, the sulfides may be formed of only one of the above-described compounds (sometimes referred to as simple substance sulfides), or may be formed of a combination of two or more types of the above-described compounds (sometimes referred to as composite sulfides). As is found by the inventors, the main component of the sulfides becomes the sulfides contains Ti in a case where the chemical composition of the wire rod is in the range according to this embodiment described above. Therefore, the grain size and the number density of the sulfides are most affected by the Ti content.

Point as Object of Measurement of Number Density of Sulfides: Area (¼D Portion) Around Depth of ¼ of Diameter D of Wire Rod from Surface of Wire Rod The object of control of the number density of the sulfides was set to an area (¼D portion) around the depth of ¼ of the diameter D of the wire rod described above. As described above, the ¼D portion of the wire rod is an area that has the most average properties in the wire rod. Therefore, this area was determined as a point where the number density of the sulfides is defined.

Size of Sulfides as Object of Measurement of Number Density: 10 to 100 nm

Average Number Density of Sulfides Having Grain Size of 10 to 100 nm at ¼D Portion: Preferably 0.025 Grains/$\mu m^3$ or More The austenite grain pinning force of the sulfides is determined by the total volume fraction of the sulfides and the number density thereof, and particularly the number density is an important factor. With respect to the state of sulfides present in steel, the inventors found that in a case where sulfides of 10 to 100 nm that are present along prior austenite grain boundaries at the ¼D portion of the wire rod are distributed at an average number density of 0.025 grains/$\mu m^3$ or more, austenite is more preferably refined. Therefore, the average number density of the sulfides having a grain size of 10 to 100 nm in the ¼D portion of the wire rod according to this embodiment is preferably 0.025 grains/$\mu m^3$ or more, more preferably 0.030 grains/$m^3$ or more, and even more preferably 0.040 grains/$m^3$ or more.

Figure 4:
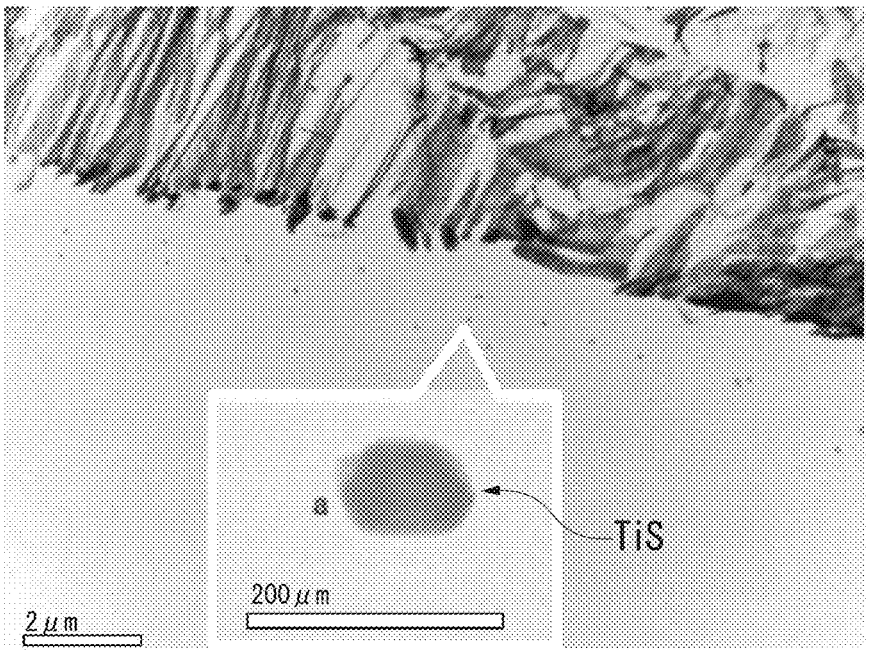
FIG. 4 is a photograph of sulfides precipitated in a dotted line pattern, which are contained in the wire rod according to the embodiment in which the state of the sulfides is preferably controlled.

FIG. 4 is a TEM photograph of a wire rod in which the state of sulfides falls within the range defined above. The boundary between the black area in the upper section of the photograph and the white area in the lower section of the photograph is a prior austenite grain boundary, and grains distributed in the white area along the prior austenite grain boundary are the sulfides described above.

In addition, the presence of coarse sulfides is accepted. There may be cases where MnS (coarse MnS) having a grain size of more than 100 nm is included in the wire rod according to this embodiment. However, coarse MnS does not precipitate in a large amount as long as the Mn content and the S content do not exceed the numerical value ranges described above. Therefore, there is no concern that coarse MnS may deteriorate the properties of the wire rod. In addition, there is concern that sulfides (coarse sulfides) having a diameter of more than 100 nm excluding coarse MnS may decrease the number density of the sulfides having a diameter of 10 to 100 nm and deteriorate the ductility of the wire rod. However, similarly to the coarse MnS described above, in a case where the S content is caused to be in the above-described range, coarse sulfides are not generated in such an amount that the ductility of the wire rod is deteriorated. Therefore, there is no need to define the number density of the coarse sulfides.

It is assumed that although the effect of sulfides (ultrafine sulfides) having a diameter of less than 10 nm on the properties of the wire rod is not clear, the sulfides do not impair at least the properties of the wire rod. Therefore, there is no need to define the number density of ultrafine sulfides.

In addition, although the upper limit of the average number density of the sulfides having a grain size of 10 to 100 nm in the ¼D portion is not particularly defined, since it is presumed that the maximum number density of sulfides that can be precipitated at grain boundaries is about 1.5 grains/$\mu m^3$, the upper limit thereof may be set to, for example, 1.5 grains/$\mu m^3$.

A method of measuring the average number density of the sulfides having a grain size of 10 to 100 nm in the ¼D portion is as follows. First, the wire rod is reheated to 900° C. and is then rapidly cooled by water or oil quenching. By this operation, structures such as cementite that impede the measurement of the number density of the sulfides can be eliminated. On the other hand, this operation does not change the morphology (number density, position, shape, and the like) of the sulfides. Next, a cross section of the wire rod perpendicular to the rolling direction is electrolyzed by a Selective Potentiostatic Etching by Electrolytic Dissolution Method (SPEED method) to reveal the prior austenite grain boundaries and sulfides, and a blank extraction replica sample is produced. When the cross section of the wire rod perpendicular to the rolling direction is processed into a size of about 3 mmφ before performing the electrolyzation operation, the electrolyzation operation can be easily performed. However, in this case, the ¼D portion of the wire rod has to be included in the processed sample. Thereafter, the ¼D portion of the sample is imaged using TEM, and the number density of the sulfides having a grain size of 10 to 100 nm in the obtained TEM photograph is measured. In the electrolyzation operation described above, it is difficult to preferably clarify all the prior austenite grain boundaries. Therefore, typically, an area where the number density of the sulfides cannot be measured is included in the TEM photograph. Therefore, during the measurement of the number density, an area of 300 μm in length and width in which prior austenite grain boundaries are preferably revealed is selected from the TEM photograph, and the number density in this area may be measured. This operation is performed on three or more cross sections, and the number densities of the sulfides having a grain size of 10 to 100 nm in the respective cross sections are averaged, thereby obtaining the average number density of the sulfides having a grain size of 10 to 100 nm in the ¼D portion.

Sulfides having a diameter of 10 to 100 nm precipitate along the prior austenite grain boundaries and rarely precipitate in areas distant from the prior austenite grain boundaries. Therefore, in a case where the measurement is performed according to the above-described method, the number density of the sulfides precipitated along the prior austenite grain boundaries is measured. However, for example, a range within 3 μm from the prior austenite grain boundary may be regarded as an "area along the prior austenite grain boundary", sulfides included in the area along the prior austenite grain boundary may be regarded as "sulfides distributed along the prior austenite grain boundary", and only the sulfides may be measured. According to the findings of the inventors, substantially the same value can be obtained by any means.

Next, a method of manufacturing the wire rod of the present invention will be described.

The method of manufacturing the wire rod, which satisfies all the above-described conditions, is as follows.

First, in order to prevent precipitation of coarse TiN-type inclusions and promote precipitation of Ti sulfides in a continuous casting or casting stage, it is effective to control the cooling rate of the surface of a bloom to 1° C./sec or more in a temperature range of 1,500° C. to 1,400° C. TiN-type inclusions include those generated in a process of solidification of a bloom and those precipitated during reheating of the bloom. In general, TiN-type inclusions generated in the process of solidification of a bloom have a large size. Therefore, by increasing the cooling rate in the temperature range in which the bloom solidifies, the size of the TiN-type inclusions can be controlled to be small. In a case where the cross-sectional size of the bloom is 0.2 $m^2$ or less, when the cooling rate of the surface of the bloom is controlled to be 1° C./sec or more, the cooling rate of the center of the bloom is estimated to be 0.05° C./sec or more. The cooling rate of the surface of the bloom is preferably 2° C./sec or more, and more preferably 5° C./sec or more. The upper limit of the cooling rate of the surface of the bloom is not particularly defined.

Next, the bloom after the casting is subjected to blooming to produce a billet having a cross section of 122 mm×122 mm, and the billet is hot-rolled to obtain a wire rod. The bloom is heated in a temperature range of 1,220° C. to 1,300° C. at the blooming. By heating the bloom to 1,220° C. or higher, fixing of N by Ti can further proceed. The heating temperature of the bloom during the blooming is more preferably 1,240° C. or higher. In addition, when the heating temperature of the bloom during the blooming is too high, there is concern that the TiN-type inclusions contained in the bloom may become coarse, the center segregation portion of the bloom may exceed the liquidus temperature and melt, and the bloom may be broken. Therefore, the upper limit of the heating temperature of the bloom at the blooming is set to 1,300° C. The upper limit of the heating temperature of the bloom during the blooming is preferably 1,290° C.

After heating the bloom in a temperature range of 1,220° C. to 1,300° C., the temperature of the bloom is preferably retained. The inventors found that in a case where the bloom having the above-described chemical composition is retained in the temperature range of 1,220° C. to 1,300° C., fine sulfides precipitate in the bloom, and the sulfides refine austenite as described above. In order to cause sulfides to precipitate, solute atoms have to be diffused sufficiently when the bloom is retained in the temperature range of 1,220° C. to 1,300° C. Therefore, it is necessary to select a temperature retention time that allows solute atoms to diffuse sufficiently.

The conditions for hot-wire-rod-rolling and the subsequent heat treatment method are set so as to obtain the above-described metallographic structure. For example, a preferable method of manufacturing the wire rod includes, in addition to the casting, the heating and retaining the bloom, and the blooming described above, hot-rolling a billet to obtain a wire rod, patenting the wire rod, and cooling the wire rod.

During the hot-rolling the billet, for example, the heating temperature of the billet is set to be in a range of 900° C. to 1,200° C. In addition, in order to reduce the load on a rolling mill due to the rolling reaction force of the billet, to suppress the occurrence of defects and surface layer decarburization in the wire rod, and to prevent coarsening of y grains after the end of the hot-rolling, the finish rolling temperature of the billet is set to be in a range of 800° C. to 1,050° C. In a case where the billet is not cooled between the end of the blooming described above and the start of the hot-rolling, and the temperature of the billet at the time of the start of the hot-rolling is in the above-described range, heating of the billet is not necessary.

In a case where the temperature of the bloom is not retained and sulfides are not caused to precipitate in the bloom, in order to improve the ductility of the wire rod by refining pearlite block grains of the wire rod, patenting the wire rod is performed by direct patenting treatment (DLP). On the other hand, in a case where sulfides are caused to precipitate in the bloom by retaining the temperature of the bloom, patenting the wire rod can be performed by various means such as DLP, lead patenting treatment (LP), and Stelmor. In the patenting, the temperature of a solvent and the immersion time can be appropriately selected according to the wire diameter of the wire rod after the hot-rolling, the alloying components of the wire rod, and the heating conditions of the wire rod. For example, in the patenting, the temperature of a molten salt bath or molten lead bath is set to be in a range of 400° C. to 600° C., and the time for immersing the wire rod in the molten salt bath or molten lead bath is set to be in a range of 30 to 180 seconds.

During cooling the wire rod after the patenting, cooling conditions may be selected according to the states of untransformed parts due to segregation and the amount of hydrogen in the steel. During cooling the wire rod after the patenting, for example, the cooling rate of the wire rod is set to be in a range of 1 to 100° C./sec, and the cooling finishing temperature of the wire rod is set to 150° C. or lower.

EXAMPLES

Next, examples of the present invention will be described. Conditions in the examples are merely examples of conditions employed to confirm the applicability and effects of the present invention, and the present invention is not limited to the examples of conditions. The present invention may employ various conditions without departing from the gist of the present invention as long as the object of the present invention can be achieved. In addition, in the following examples, a method of identifying the configuration of a wire rod is as follows.

The amount of Sol. N (amount of solute N) was measured according to the ammonia distillation separation amidosulfuric acid titrimetric method defined in JIS G 1228 "Iron and steel—Methods for determination of nitrogen content", in which the residue was removed.

The calculated maximum size of the TiN-type inclusions was calculated using the following means. A cross section of the wire rod in the longitudinal direction was cut, and measurement of a surface area of 12 $mm^2$ was performed on 12 points in a range from the surface layer to a depth of 10%. At this time, the value of the largest circle equivalent diameter among inclusions determined to be Ti(C,N) was defined as the actual maximum size of TiN-type inclusions, and when it is postulated that the sizes of the TiN-type inclusions for an area of a coil of 2 tons were measured through extreme value statistical processing by creating a Weibull plot from data of 8 maximum values, the maximum size of the inclusions was defined as the calculated maximum size of the TiN-type inclusions. Identification of the TiN-type inclusions and measurement of circle equivalent diameters were performed using spark discharge emission spectroscopy.

A method of measuring the average number density of sulfides having a grain size of 10 to 100 nm in the ¼D portion (the average number density of fine sulfides) is as follows. First, the wire rod was reheated to 900° C. and was then rapidly cooled by water or oil quenching. Next, a cross section of the wire rod perpendicular to the rolling direction was electrolyzed by a Selective Potentiostatic Etching by Electrolytic Dissolution Method (SPEED method) to reveal prior austenite grain boundaries and sulfides, and a blank extraction replica sample is produced. The cross section of the wire rod perpendicular to the rolling direction was processed into a size of about 3 mmϕ before performing the electrolyzation operation. At this time, the ¼D portion of the wire rod was included in the processed sample. Thereafter, the ¼D portion of the sample was imaged using TEM, and the number density of sulfides having a grain size of 10 to 100 nm in an area of 300 μm in length and width in which prior austenite grain boundaries were preferably revealed in the obtained TEM photograph was measured. This operation was performed on three cross sections, and the number densities of the sulfides having a grain size of 10 to 100 nm in the respective cross sections were averaged, thereby obtaining the average number density of the sulfides having a grain size of 10 to 100 nm (the average number density of fine sulfides) in the ¼D portion.

Example 1

In order to investigate the effect of the average number density of the sulfides having a grain size of 10 to 100 nm in the ¼D portion on the value of a reduction in the area of the wire rod, the following experiment was conducted. First, by applying Condition (3) in Table 2 to Kind of steel K in Table 1, a wire rod having sulfides which were distributed along the prior austenite grain boundaries in an area from the surface of the wire rod to a depth of ¼ of the diameter of the wire rod and had a number density of 0.100 grains/$\mu m^3$ and a grain size of 10 to 100 nm was produced. Next, the inventors produced, by applying Condition (4) in Table 2 to Kind of steel K in Table 1, a wire rod which did not have sulfides having a grain size of 10 to 100 nm in the area from the surface of the wire rod to the depth of ¼ of the diameter of the wire rod. In addition, in Direct in-Line Patenting (DLP) after hot-rolling, by varying the temperature of a molten salt bath, the tensile strengths of the wire rods were changed in a range of 1,280 to 1,400 MPa. In addition, the tensile strength, the value of a reduction in area, and the pearlite block grain sizes of the various wire rods obtained as described above were measured.

FIG. 1 is a graph showing the relationship between the tensile strength and the value of a reduction in the area of the various wire rods described above. According to FIG. 1, it is apparent that the value of a reduction in the area of the wire rod is significantly improved in a case where the average number density of sulfides having a grain size of 10 to 100 nm in the ¼D portion is 0.025 grains/$m^3$ or more.

Figure 2:
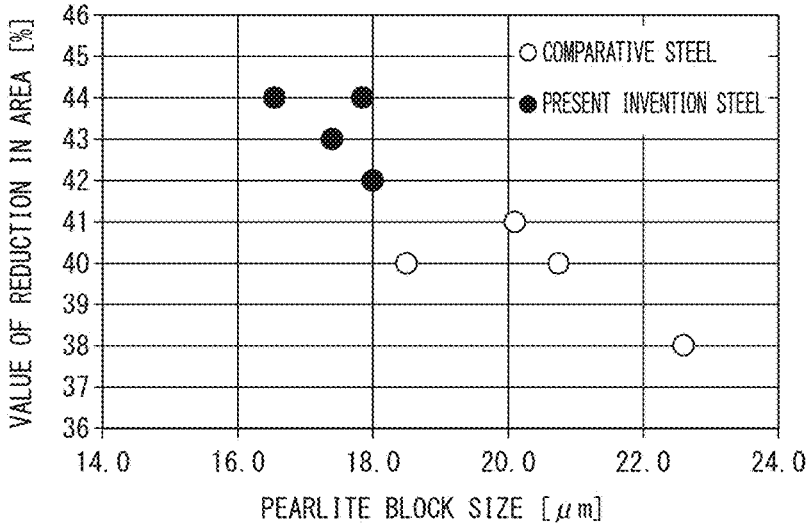
FIG. 2 is a graph showing the relationship between the pearlite block sizes and the value of a reduction in the area of the wire rods according to the embodiment in which the state of sulfides is preferably controlled, and the wire rods according to the related art.

FIG. 2 is a graph showing the relationship between the pearlite block sizes and the value of a reduction in the area of the various wire rods described above. According to FIG. 2, it is apparent that the pearlite blocks are refined in a case where the average number density of sulfides having a grain size of 10 to 100 nm in the ¼D portion is 0.025 grains/$m^3$ or more.

Example 2

Billets were obtained by rolling high carbon steel having the compositions shown in Table 1 under the conditions shown in Table 2. The billets were subjected to hot-rolling and heat treatments, thereby producing wire rods having wire diameters shown in Table 3. During hot-rolling the billet, the heating temperature of the billet was set to be in a range of 900° C. to 1,200° C., and the finish rolling temperature of the billet was set to be in a range of 800° C. to 1,050° C. During the patenting, the temperature of a molten salt bath or molten lead bath was set to be in a range of 400° C. to 600° C., and the time for immersing the wire rod in the molten salt bath or molten lead bath was set to be in a range of 30 to 180 seconds. During cooling the wire rod after the patenting, the cooling rate of the wire rod was set to be in a range of 1 to 100° C./sec, and the cooling finishing temperature of the wire rod was set to 150° C. or lower. The results of the sol. N (mass %), the actual maximum size of TiN-type inclusions (μm), the calculated maximum size of TiN-type inclusions (μm), the average size of sulfides (nm), and the number density of sulfides (grains/$m^3$) of each wire rod are shown in Table 3.

TABLE 1

| KIND OF | CHEMICAL COMPOSITION (mass %) REMAINDER: Fe AND IMPURITIES | | | | | | | | | | | | | |
|---|---|---|---|---|---|---|---|---|---|---|---|---|---|---|
| STEEL | C | Si | Mn | P | S | Ti | Al | Cr | V | Mo | Nb | W | N | B |
| A | 0.77 | 0.18 | 0.78 | 0.010 | 0.006 | 0.015 | — | — | — | — | — | — | 0.0032 | — |
| B | 0.82 | 0.20 | 0.42 | 0.012 | 0.007 | 0.010 | 0.052 | — | — | — | — | — | 0.0030 | — |
| C | 0.81 | 0.25 | 0.72 | 0.008 | 0.015 | 0.024 | — | — | — | — | — | — | 0.0030 | — |
| D | 0.81 | 0.92 | 0.72 | 0.010 | 0.008 | 0.015 | 0.030 | — | — | — | — | — | 0.0039 | — |
| E | 0.82 | 0.22 | 0.35 | 0.008 | 0.006 | 0.013 | 0.035 | 0.24 | — | — | — | — | 0.0048 | — |
| F | 0.83 | 0.19 | 0.72 | 0.009 | 0.008 | 0.013 | 0.035 | 0.10 | 0.02 | — | — | — | 0.0048 | 0.0005 |
| G | 0.84 | 0.11 | 0.21 | 0.010 | 0.005 | 0.029 | — | — | — | 0.08 | — | — | 0.0036 | — |
| H | 0.82 | 0.18 | 0.90 | 0.011 | 0.006 | 0.018 | — | — | — | — | 0.02 | 0.05 | 0.0025 | — |
| I | 0.81 | 0.28 | 0.71 | 0.006 | 0.006 | 0.015 | — | — | — | — | — | — | 0.0041 | — |
| J | 0.82 | 0.21 | 0.75 | 0.009 | 0.008 | 0.018 | — | — | — | — | — | — | 0.0035 | 0.0010 |
| K | 0.92 | 0.25 | 0.67 | 0.009 | 0.004 | 0.012 | 0.028 | 0.04 | — | — | — | — | 0.0031 | — |
| L | 0.92 | 1.05 | 0.30 | 0.008 | 0.006 | 0.015 | 0.035 | 0.27 | — | — | — | — | 0.0024 | 0.0015 |
| M | 0.97 | 0.19 | 0.72 | 0.009 | 0.008 | 0.020 | — | 0.10 | — | — | — | — | 0.0049 | — |
| N | 1.01 | 0.38 | 0.39 | 0.012 | 0.009 | 0.008 | 0.030 | 0.24 | — | — | — | — | 0.0030 | — |
| O | 1.12 | 0.20 | 0.40 | 0.012 | 0.008 | 0.012 | — | 0.15 | — | — | — | — | 0.0040 | — |
| P | 0.82 | 0.22 | 0.72 | 0.008 | 0.002 | 0.008 | — | — | — | — | — | — | 0.0035 | — |
| Q | 0.82 | 0.16 | 0.21 | 0.01 | 0.005 | 0.073 | 0.029 | 0.25 | — | — | — | — | 0.0036 | — |
| R | 0.93 | 0.21 | 0.66 | 0.005 | 0.006 | 0.001 | 0.023 | — | — | — | — | — | 0.0025 | — |
| S | 1.02 | 0.18 | 0.32 | 0.010 | 0.007 | 0.008 | — | — | — | — | — | — | 0.0085 | — |

TABLE 2

| CON-DITION No. | COOLING RATE OF CENTER PORTION AT CASTING [° C./sec] | HEATING TEMPERATURE AT BLOOMING [° C.] | HEATING TIME AT BLOOMING [min] |
|---|---|---|---|
| (1) | 0.05 | 1240 | 240 |
| (2) | 0.10 | 1220 | 300 |
| (3) | 0.10 | 1280 | 900 |
| (4) | 0.10 | 1280 | 180 |
| (5) | 0.05 | 1180 | 300 |

TABLE 3

| TEST No. | CLASSIFICATION | STEEL | PROCESSING CONDITION | WIRE DIAMETER [mm] | WIRE ROD HEAT TREATMENT | Sol. N [mass %] |
|---|---|---|---|---|---|---|
| 1 | EXAMPLE | A | (2) | 8.0 | DLP | 0.0010 |
| 2 | STEEL | B | (2) | 8.0 | DLP | 0.0011 |
| 3 | | C | (2) | 8.0 | DLP | 0.0006 |
| 4 | | C | (2) | 8.0 | LP | 0.0007 |
| 5 | | D | (1) | 14.0 | DLP | 0.0010 |
| 6 | | E | (2) | 11.0 | DLP | 0.0015 |
| 7 | | F | (2) | 11.0 | STM | 0.0015 |
| 8 | | G | (2) | 8.0 | DLP | 0.0004 |
| 9 | | H | (2) | 8.0 | DLP | 0.0006 |

TABLE 3-continued

| | | | | | | |
|---|---|---|---|---|---|---|
| 10 | | I | (2) | 8.0 | DLP | 0.0009 |
| 11 | | J | (2) | 8.0 | DLP | 0.0007 |
| 12 | | K | (3) | 11.0 | DLP | 0.0011 |
| 13 | | L | (3) | 14.0 | DLP | 0.0009 |
| 14 | | M | (3) | 8.0 | DLP | 0.0010 |
| 15 | | N | (2) | 8.0 | DLP | 0.0012 |
| 16 | | O | (1) | 8.0 | DLP | 0.0011 |
| 17 | | A | (5) | 8.0 | DLP | 0.0012 |
| 18 | | C | (4) | 8.0 | DLP | 0.0006 |
| 19 | | K | (4) | 11.0 | DLP | 0.0010 |
| 20 | | P | (2) | 8.0 | DLP | 0.0015 |
| 21 | COMPARATIVE | Q | (2) | 8.0 | DLP | 0.0001 |
| 22 | EXAMPLE | R | (3) | 11.0 | DLP | 0.0021 |
| 23 | STEEL | S | (3) | 8.0 | DLP | 0.0072 |

| TEST No. | ACTUAL MAXIMUM SIZE OF TiN-TYPE INCLUSIONS [μm] | CALCULATED MAXIMUM SIZE OF TiN-TYPE INCLUSIONS [μm] | AVERAGE SIZE OF SULFIDES [nm] | AVERAGE NUMBER DENSITY OF FINE SULFIDES [grains/μm$^3$] |
|---|---|---|---|---|
| 1 | 11.5 | 37.2 | 33 | 0.035 |
| 2 | 10.2 | 20.6 | 26 | 0.025 |
| 3 | 18.5 | 46.9 | 45 | 0.068 |
| 4 | 16.5 | 45.6 | 45 | 0.058 |
| 5 | 12.1 | 30.4 | 28 | 0.038 |
| 6 | 12.6 | 32.7 | 30 | 0.033 |
| 7 | 11.5 | 32.8 | 30 | 0.028 |
| 8 | 19.8 | 48.5 | 47 | 0.085 |
| 9 | 15.5 | 40.2 | 34 | 0.045 |
| 10 | 14.8 | 45.1 | 33 | 0.038 |
| 11 | 16.2 | 38.8 | 37 | 0.030 |
| 12 | 11.2 | 27.2 | 98 | 0.100 |
| 13 | 11.3 | 25.1 | 33 | 0.138 |
| 14 | 12.5 | 42.9 | 139 | 0.143 |
| 15 | 12.0 | 31.7 | 25 | 0.025 |
| 16 | 13.5 | 36.1 | 30 | 0.030 |
| 17 | 12.0 | 30.7 | — | — |
| 18 | 19.5 | 45.8 | 39 | 0.013 |
| 19 | 12.5 | 37.9 | — | — |
| 20 | 12.8 | 34.5 | — | — |
| 21 | 55.0 | 164.2 | 165 | 0.117 |
| 22 | 6.5 | 21.6 | — | — |
| 23 | 10.5 | 37.2 | 75 | 0.008 |

Examples 1 to 20 are examples of the wire rod having the configuration defined in the present invention. These examples were excellent in drawability and fatigue strength. In addition, in the examples having appropriate S contents and manufacturing methods, the average number density of fine sulfides was 0.025 grains/m$^3$ or more, and thus particularly drawability and fatigue strength were excellent.

In Comparative Example 21, since the Ti content was excessive, the calculated maximum size of TiN-type inclusions became coarse. In Comparative Example 22, since the Ti content was insufficient, N was not sufficiently fixed, and Sol. N was excessive. In Comparative Example 23, since the amount of N was excessive, Sol. N was excessive. In these comparative examples, one or both of the drawability and fatigue strength were inferior to the examples.

INDUSTRIAL APPLICABILITY

As described above, according to the present invention, a wire rod having excellent drawability and fatigue resistance can be provided.

The invention claimed is:

1. A wire rod, comprising: in terms of mass %,

C: 0.75% to 1.2%;

Si: 0.10% to 1.4%;

Mn: 0.1% to 1.1%;

Ti: 0.008% to 0.03%;

S: 0.003% to 0.030%;

P: 0.03% or less;

N: 0.001% to 0.005%;

Al: 0% to 0.1%;

Cr: 0% to 0.6%;

V: 0% to 0.1%;

Nb: 0% to 0.1%;

Mo: 0% to 0.2%;

W: 0% to 0.5%;

B: 0% to 0.003%; and a remainder comprising Fe and impurities, wherein a solute N is 0.0015% or less, wherein a structure in an area from a surface of the wire rod to a depth of ¼ of a diameter of the wire rod in a cross section thereof includes 90.0 area % or more of pearlite, and 0 to 10.0 area % in total of bainite and ferrite, wherein a total amount of martensite and cementite in the area from the surface of the wire rod to the depth of ¼ of the diameter of the wire rod is limited to 2.0 area % or less, wherein a part from the surface of the wire rod to a depth of 10% of the diameter of the wire rod is defined as a surface layer area of the wire rod, wherein a maximum circle equivalent diameter of TiN-type inclusions included in visual field of 12 mm$^2$ in a cross section, which is parallel to a rolling direction and which includes a center of the wire rod, of the surface layer area is defined as an actual maximum size of TiN-type inclusions in the surface layer area of the wire rod, wherein an estimate value of a maximum circle equivalent diameter of the TiN-type inclusions included in the surface layer area of the wire rod having a length corresponding to a coil of 2 tons, which is obtained by extreme value statistical processing a Weibull plot created by the actual maximum size of the TiN-type inclusions in 12 or more of the visual fields of the surface layer area of the wire rod, is defined as a calculated maximum size of TiN-type inclusions in the surface layer area of the wire rod, wherein the calculated maximum size of the TiN-type inclusions in the surface layer area of the wire rod is 50 μm or less, and wherein a sulfide which is distributed along a prior austenite grain boundary and has an average number density of $0.025/\mu m^3$ or more and a grain size of 10 to 100 nm is included in the area from the surface of the wire rod to the depth of ¼ of the diameter of the wire rod.

2. The wire rod according to claim 1, further comprising: in terms of mass %, one or more selected from the group consisting of Al: 0.001% to 0.1%;
Cr: 0.03% to 0.6%;
V: 0.005% to 0.1%;
Nb: 0.005% to 0.1%;
Mo: 0.005% to 0.2%;
W: 0.010% to 0.5%; and
B: 0.0004% to 0.003%.

* * * * *